United States Patent [19]

Ishibashi et al.

[11] Patent Number: 5,054,280

[45] Date of Patent: Oct. 8, 1991

[54] GAS TURBINE COMBUSTOR AND METHOD OF RUNNING THE SAME

[75] Inventors: Yoji Ishibashi; Hiroshi Inoue; Takashi Ohmori, all of Hitachi; Takashi Hashimoto, Ushiku; Fumio Kato, Ibaraki; Shigeyuki Akatsu, Hitachi; Akira Arai, Tsukuba; Michio Kuroda; Katsukuni Hisano, both of Hitachi, all of Japan

[73] Assignee: Hitachi, Ltd., Tokyo, Japan

[21] Appl. No.: 582,395

[22] Filed: Sep. 12, 1990

Related U.S. Application Data

[62] Division of Ser. No. 387,983, Aug. 1, 1989.

[30] Foreign Application Priority Data

Aug. 8, 1988 [JP] Japan ..... 63-195987

[51] Int. Cl.[5] ..... F02C 3/28; F23R 3/34

[52] U.S. Cl. ..... 60/39.06; 60/733; 60/738; 60/747; 60/749

[58] Field of Search ..... 60/39.06, 722, 732, 60/733, 734, 737, 738, 749, 746, 39.03, 747

[56] References Cited

U.S. PATENT DOCUMENTS

| | | | |
|---|---|---|---|
| 3,937,008 | 2/1976 | Markowski et al. | 60/733 |
| 4,344,280 | 8/1982 | Minikawa et al. | 60/747 |
| 4,701,124 | 10/1987 | Magwon et al. | 60/747 |
| 4,735,052 | 4/1988 | Maeda et al. | 60/733 |
| 4,910,957 | 3/1990 | Moreno et al. | 60/737 |
| 4,949,538 | 8/1990 | Iasillo et al. | 60/733 |
| 4,993,222 | 2/1991 | Iwai et al. | 60/39.06 |

*Primary Examiner*—Louis J. Casaregola
*Assistant Examiner*—John A. Savio, III
*Attorney, Agent, or Firm*—Antonelli, Terry, Stout & Kraus

[57] ABSTRACT

A gas turbine combustor including a first-stage combustion chamber being arranged to serve as a premix chamber for a second-stage combustion chamber and an auxiliary burner provided in the first-stage combustion chamber and arranged to effect, when fired, combustion and holding of a flame in the first-stage combustion chamber and to effect, when extinguished, feed a flame from the first-stage combustion chamber to the second-stage combustion chamber; and a method of driving the gas turbine combustor including a step of preparing the auxiliary burner in the first stage combustion chamber, the auxiliary burner being sparked when said combustion is fired, and causing the first-stage combustion camber to serve as the premixing chamber for the second-stage combustion chamber by extinguished the auxiliary burner.

6 Claims, 8 Drawing Sheets

GAS TURBINE COMBUSTOR AND METHOD OF RUNNING THE SAME

This is a division of application Ser. No. 387,983, filed Aug. 1, 1989.

BACKGROUND OF THE INVENTION

1. Field of the Invention

The present invention relates to a gas turbine combustor and a method of running the gas turbine combustor and, more particularly, to a premix type of gas turbine combustor and a method of running the above gas turbine combustor.

2. Description of the Related Art

As disclosed in, for example, Japanese Patent Unexamined Publication No. 56-25622, conventional combustors of this type which have generally been used are commonly provided with several stages of combustion sections and are arranged as a premix-combustion system so as to suppress the generation of NOx by means of combustion with a lean mixture.

FIG. 11 shows in cross section the essential portion of a typical combustor of this type. This combustor comprises a first-stage burner a (a plurality of diffusion burners for separately supplying fuel and air) disposed upstream of the combustor and a second-stage burner b (a similar diffusion burner) disposed downstream of the first-stage burner a in such a manner as to project into the combustor. The combustion chambers for the respective burners are divided by a throat portion into an upstream first-stage combustion chamber 1 and a downstream second-stage combustion chamber 2, the throat portion having a diameter reduced compared to the line size and being formed between the combustion chambers 1 and 2.

The above-described combustor operates as follows. At the time of starting, fuel is first supplied to the first-stage combustion chamber 1 alone to fire the first-stage burner a. Then, fuel is supplied to the second-stage burner b to fire the second-stage burner b. In this state, both the first-stage burner a and the second-stage burner b bring about diffusion combustion.

Subsequently, the supply of fuel to the first-stage burner a is stopped and the rate of fuel supplied to the second-stage burner b is increased by a corresponding amount, thereby extinguishing the first-stage burner a. At the same time, the amount of combustion at the second-stage burner b is increased.

Thereafter, by again supplying fuel to the first-stage burner a, the combustion chamber 1 for the first-stage burner a is made to serve as a premixing chamber for merely premixing fuel and air, and premix combustion is effected in the second-stage combustion chamber 2. In other words, the steady running of the combustor is performed in the above-described state.

In the combustor which is arranged in the above-described manner, during the steady running, it is possible to extremely effectively realize low-NOx combustion since premix combustion is performed during the steady running. However, as described previously, during starting, i.e. during the change from diffusion combustion to premix combustion, since it is necessary to input fuel to the second-stage burner b at a high flow rate, the second-stage burner b is overloaded and the metal temperature of the combustor rises to a extremely high degree. In addition, prior to the change to premix combustion, the first-stage and second-stage burners a and b are both in the state of diffusion combustion and, therefore, a large amount of NOx is produced during this time, and, during the steady running, the second-stage burner burning in the state of diffusion combustion, which producing relative larger amount of NOx than premixed combustion of the first-stage burner.

SUMMARY OF THE INVENTION

It is, therefore, an object of the present invention to provide a gas turbine combustor in which a burner is always free from overload conditions, that is, the burner metal is not heated to an excessively high temperature and which is capable of realizing low-NOx combustion even at the time of starting. It is a further object of this invention to provide a complete premixing combustion system for producing ultra low emission of NOx.

To this end, in accordance with the present invention, an auxiliary burner is provided in the interior of a first-stage combustion chamber located upstream of a combustor, the auxiliary burner being fired to hold the flame formed in the first-stage combustion chamber and being extinguished to cause the first-stage combustion chamber to serve as a premixing chamber.

In the arrangement and construction which include the auxiliary burner described above, when the auxiliary burner is fired, diffusion-combustion flame and premixture flame are formed in the first-stage combustion chamber and the second-stage combustion chamber, respectively. When the fuel feeding for the auxiliary burner is stopped, the first-stage combustion chamber serves as a premixing chamber, and the premixture in the premixing chamber together with the second-stage premixed combustion flame is flame-holding within the second-stage combustion chamber, whereby a first-stage fuel also undergoes premix combustion. In this manner, the first-stage fuel and the second-stage fuel undergo complete premixed combustion. During the above-described change, fuel for the auxiliary burner is supplied as the first-stage fuel. In addition, since no diffusion combustion occurs, complete premixed combustion can be obtained.

DESCRIPTION OF THE PREFERRED EMBODIMENT

An embodiment of a gas-turbine combustor according to the present invention will be described below with reference to the accompanying drawings.

Figure 1:
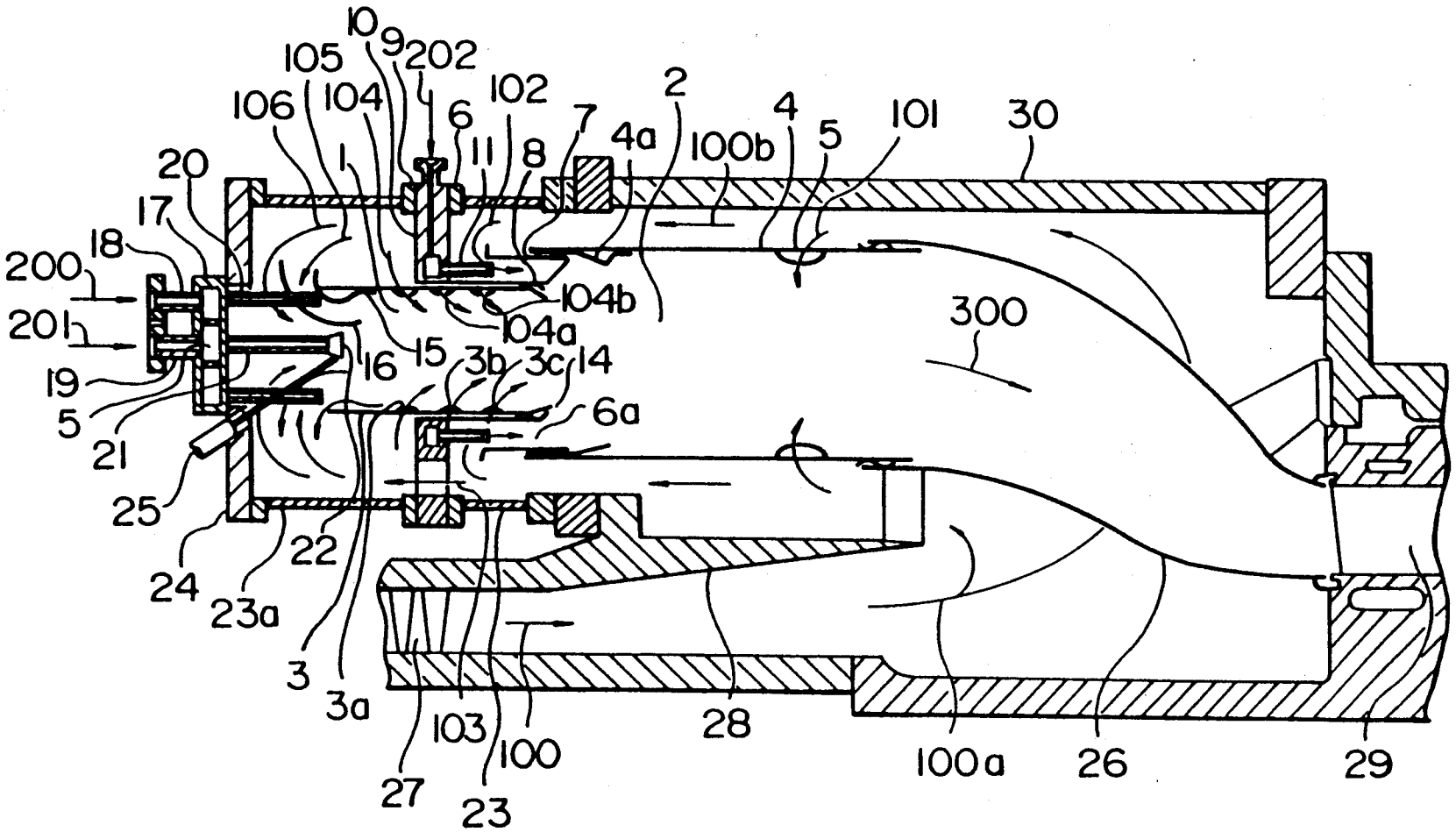
FIG. 1 is a longitudinal sectional view showing an embodiment of a gas turbine combustor in accordance with the present invention.

FIG. 1 shows the combustor in section, and this combustor comprises the following major elements: a first-stage combustion chamber 1, a second-stage combustion chamber 2, a combustion linear 3 which forms the first-stage combustion chamber 1, a combustion linear 4 which forms the second-stage combustion chamber 2, a first-stage fuel supplying device 5 for supplying fuel to the first-stage combustion chamber 1, a second-stage fuel supplying device 6 for supplying fuel to the second-stage combustion chamber 2, and an air compressor 7 for supplying air to each of the combustion chambers 1 and 2.

Referring to the outline of the operation of the gas-turbine combustor, high-pressure air 100 supplied through a portion projecting from the compressor 27 is introduced into the combustor while fuel is being supplied to the combustor through fuel lines 200, 201 and 202. This fuel is burned to generate a high-temperature combustion gas 300. This high-temperature combustion gas 300 is injected into a turbine 29 through a combustor transition piece 26 which is located downstream of the combustor, thereby effecting driving of the turbine.

Individual portions of the combustor will be explained below. Each of the combustion liners 3 and 4 has a cylindrical configuration which extends along the longitudinal axis thereof. The first-stage combustion linear 1 is located upstream of the second-stage combustion linear 2, and the diameter of the first-stage combustion linear 3 is reduced compared to that of the second-stage combustion linear 4. The upstream end portion of the second-stage combustion linear 4 is connected to the downstream end portion of the first-stage combustion linear 3 via a premixer 6*a*. A plurality of openings 3*a* for introduction of combustion air are formed in the wall portion of the first-stage combustion linear 3. Although not shown, cooling slots for supply of cooling air are also formed in this wall portion.

A liner cap 15 is secured to the upstream end of the first-stage combustion liner 3. The liner cap 15 is configured such as to cover the gap formed around the circumference of the upstream opening of the first-stage combustion linear 3, extend into the first-stage combustion chamber 1 with its diameter gradually reduced in the downstream direction of the combustor, reach its minimum diameter at a location corresponding to the entrance portion of the first-stage combustion chamber 1, and extend further in the downstream direction with its diameter increased gradually, the terminal end portion of the linear cap 15 making contact with the inner wall surface of the first-stage combustion linear 3.

An auxiliary-burner cap 16 is located upstream of the linear cap 15. This cap 16 is spaced apart from the liner cap 15 by an appropriate interval determined by the rate of air flowing into the combustor. Similar to the configuration of the liner cap 15, the cap 16 extends into the combustor with its diameter gradually reduced in the downstream direction, and terminates at a location slightly downstream of the minimum-diameter portion of the liner cap 15.

The liner cap 15 and the auxiliary-burner cap 16 are combined to form an annular space which defines a throat portion at the inlet portion of the first-stage combustion chamber 1, and a portion 105 of combustion air for use in the first-stage combustion chamber 1 is supplied through the annular space.

A plurality of first-stage fuel nozzles 20 are secured upstream of the throat portion of the annular space. Disposed inside the auxiliary-burner cap 16 are an auxiliary-fuel nozzle 21 which has a flame holder 22 at its terminal end and a sparking plug 25 the projecting end of which is located downstream of the auxiliary-fuel nozzle 21. Air 106 for combustion with auxiliary fuel is supplied to an auxiliary burner through the space defined between the auxiliary-burner cap 16 and the auxiliary-fuel nozzle 21. Each of the first-stage fuel nozzles 20 and the auxiliary-fuel nozzle 21 are respectively connected to a first-stage fuel header 18 and an auxiliary-burner fuel header 19 both of which are separated by a partition means within a first-stage fuel nozzle body 17. A flame arrestor board 14, which extends with its diameter gradually reduced in the downstream direction, is secured to the downstream end of the first-stage combustion liner 3.

The premixer 6*a*, which serves as a second-stage burner, is disposed at the junction between the first-stage combustion liner 3 and the second-stage combustion liner 4. This second-stage burner is composed of a plurality of second-stage fuel nozzles 11 which are disposed in a second-stage combustion-air passage which is defined by a flow-passage inner wall member 8 and a flow-passage outer wall member 37. A downstream end portion of the first-stage combustion liner 3 is secured to the inner periphery of the flow-passage inner wall member 8 by means of a spring seal, while the second-stage combustion chamber 2 is secured to the outer periphery of the flow-passage outer wall member 7 by a similar spring seal, so as to absorb thermal expansion. The second-stage fuel nozzles 11 are secured to a second-stage fuel header 10 which is provided in a second-stage fuel supply flange 9 having an opening which allows air to flow into the first-stage combustion chamber 1.

The inner wall surface of the second-stage combustion liner 4 is provided with a flame holder 4*a*. This flamer holder 4*a* is located downstream of the outlet portion of the aforesaid premixer 6*a* and is arranged to extend in the combustor in the downstream direction thereof with its diameter gradually reduced in the same direction, the diameter being abruptly increased at the end portion. Although not shown, the second-stage combustion liner 4 is provided with cooling slots for supplying air to cool the wall portion and bores for supplying air to cool the aforesaid flame holder 4*a*. In addition, formed in a downstream portion of the second-stage combustion liner 4 are dilution-air apertures 5 through which dilution air 101 is supplied in order to cool the combustion gas to a predetermined temperature. A downstream end of the second-stage combustion liner 4 is formed so that it can be fitted into the inner periphery of the combustor transition piece 26 with a spring seal interposed therebetween.

Figure 2:
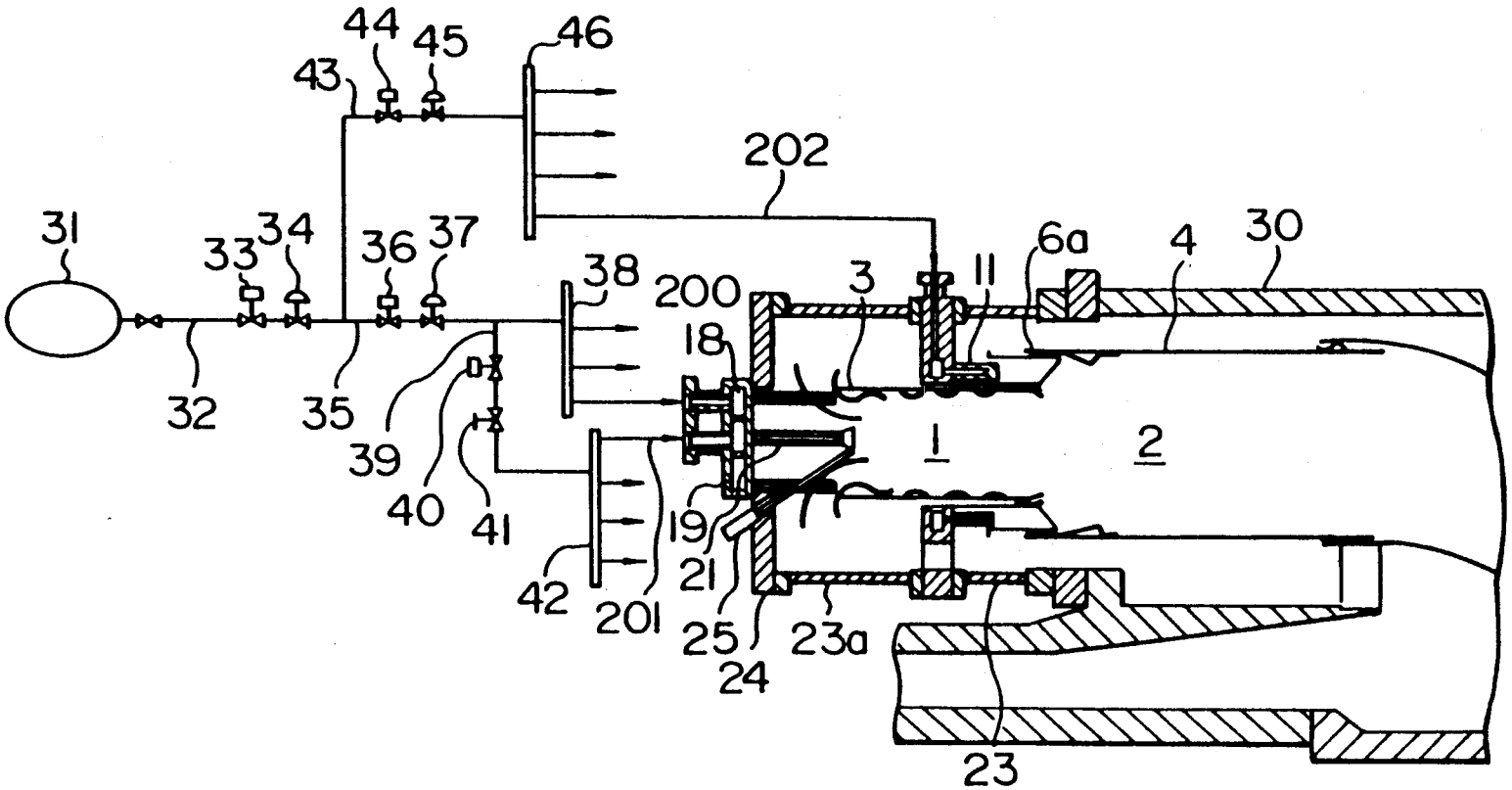
FIG. 2 is a schematic diagram showing the fuel supply lines used in the embodiment of FIG. 1.

FIG. 2 shows the outline of the main construction of fuel supply lines used in the embodiment of the combustor according to the present invention. As illustrated, a main fuel supply pipe 32, which extends from a fuel supply installation 31, is provided with a main pressure regulating valve 33 which serves to supply fuel at a predetermined flow rate determined by the output requirements of the gas turbine employed, as well as a main flow regulating valve 34. A first-stage fuel line 35 and a second-stage fuel line 43 branch from the main fuel supply pipe 32 at a location downstream of the main flow regulating valve 34. For the purpose of supplying fuel at a predetermined flow rate, the first-stage fuel line 35 is provided with a pressure regulating valve 36 and a flow regulating valve 37, while the second-stage fuel line 43 is provided with a pressure regulating valve 44 and a flow regulating valve 45. A first-stage fuel 200 and a second-stage fuel 202 are supplied to corresponding combustion chambers through a first-stage fuel manifold 38 and a second-stage fuel manifold 46, respectively.

An auxiliary-burner fuel pipe 39 branches from the first-stage fuel line 35 at an intermediate position between the flow regulating valve 37 and the first-stage fuel manifold 38, and an auxiliary-burner fuel 201 is supplied t the auxiliary-fuel nozzle 21 of each combustor through a pressure regulating valve 40, a flow control valve 41 and an auxiliary-fuel manifold 42.

Figure 3:
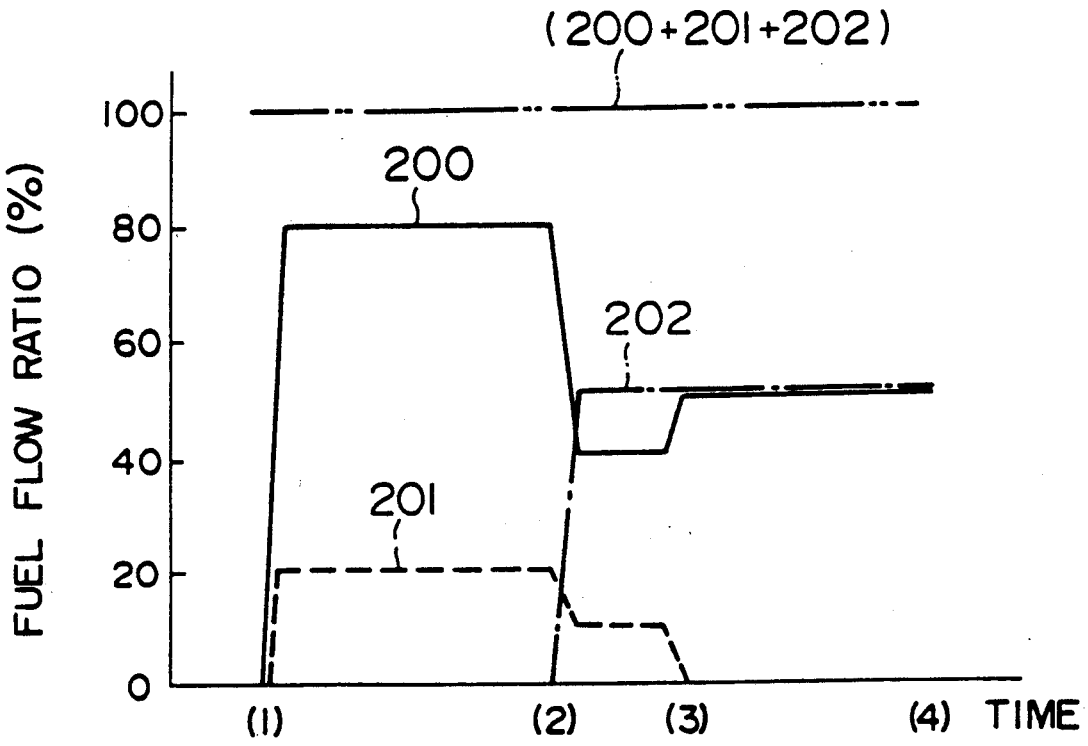
FIG. 3 is a graphic representation showing the relationship between time and the amount of supply of fuel.

Then, the operation of the gap turbine combustor which is configured in the above-described manner will be explained below with reference to FIGS. 2 and 3. FIG. 3 serves to illustrate a method of charging fuel into the embodiment of the gas turbine combustor in accordance with the present invention, and shows the ratio of fuel flow with respect to the time period which elapses from the instant that the gas turbine is started until the instant that the gas turbine reaches the state of running under loaded conditions.

Initially, at time (1) in FIG. 3, the gas turbine is fired and started. This is achieved by supplying the first-stage fuel 200 and the auxiliary-burner fuel 210 to the first-stage combustion chamber 1, firing the auxiliary burner by means of the sparking plug 25 provided therein, and burning the first-stage fuel 200 with this firing.

Figure 4:
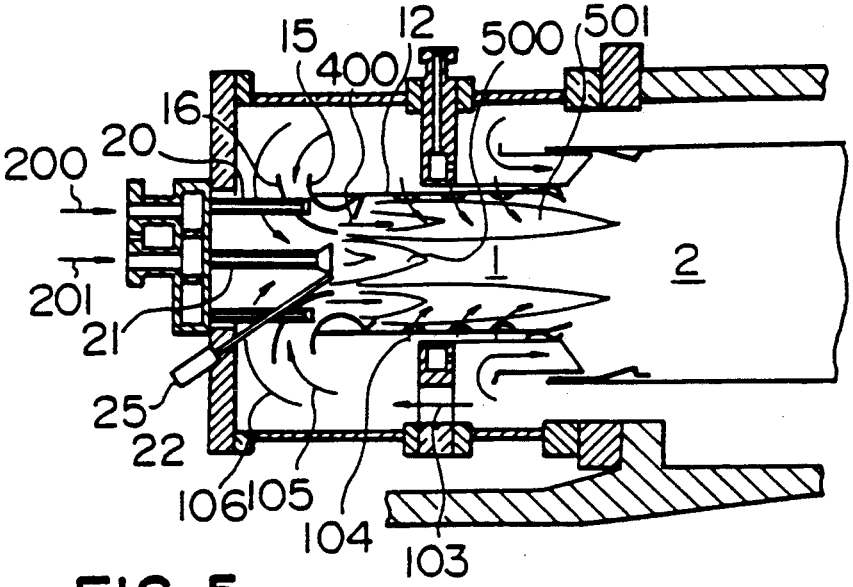
FIGS. 4 to 6 are partial longitudinal sectional views showing the forms of combustion flames formed in respective combustion steps.

The state of the flame thus formed is shown in FIG. 4. As illustrated, an auxiliary-burner flame 500 is held by the auxiliary-burner flame holder 22 so as to burn stably. Incidentally, this auxiliary-burner flame holder 22 may be of a baffle type which serves, as illustrated, to form a reverse flow are at a location downstream of the flame holder, or of a swirling type which is commonly employed. The first-stage fuel 200 is mixed with the portion 105 of combustion air for use in the first-stage combustion chamber 1 within a curved passage formed by the liner cap 15 and the auxiliary-burner cap 16. The thus-obtained mixture is supplied to the first-stage combustion chamber 1 in the form of a first-stage premixture 400. This first-stage premixture 400 is supplied to the first-stage combustion chamber 1 normally at a mixture ratio which corresponds to the theoretical amount of air or below, that is to say, in the form of a premixture which contains a high concentration of fuel. In addition, the first-stage premixture is supplied through the curved passage having such a curved configuration that does not induce any reverse flow or the like. Accordingly, with such a premixture alone, it is in general impossible to form a stable flame. For this reason, in the construction and arrangement of the embodiment according to the present invention, the auxiliary-burner flame 500 is formed within the first-stage premixture flow 400 and the obtained thermal effect is utilized to fire the first-stage premixture flow 400 and hold the resulting flame, thereby forming a first-stage combustion flame 501 in the first-stage combustion chamber 1. The auxiliary-burner flame 500 and the first-stage combustion flame 501 brings about diffusion combustion and therefore, their stable combustion ranges are wide.

Referring back to FIG. 3, the flow rate of the first-stage fuel 200 and the auxiliary-burner fuel 201 are increased at the approximately same ratio under the above-described conditions, and the change from first-stage combustion to second-stage combustion is effected at time (2) at which the load of the gas turbine a predetermined level. More specifically, this change is accomplished by decreasing the flow rates of both the first-stage fuel 200 and the auxiliary-burner fuel 201 to the respective predetermined flow rates at substantially the same ratio in a stepwise manner while supplying the second-stage fuel 202 by an amount corresponding to the amount of fuel decreased in this manner.

Figure 5:
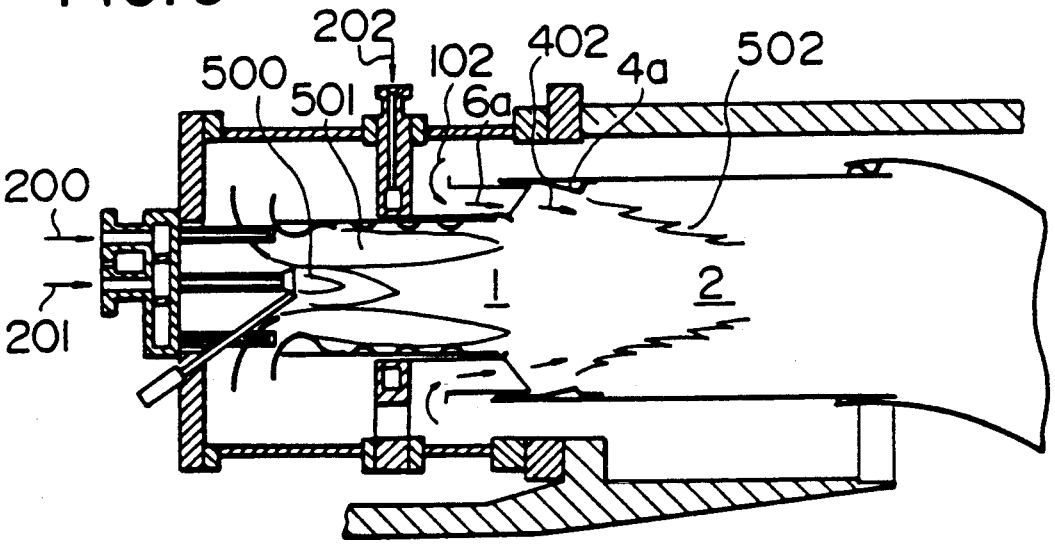

FIG. 5 shows the state of flame formed after the change from first-stage combustion to second-stage combustion has been effected. More specifically, the second-stage fuel 202 is mixed with second-stage combustion air 102 in the premixing chamber **6*a* and is in turn supplied to the second-stage combustion chamber 2 in the form of a second-stage premixture flow 402. This flow 402 is thermally fired by a high-temperature combustion gas produced by the first-stage combustion flame 501, and is stabilized by means of the flame holder 4*a*. The second-stage combustion flame thus formed is designated by 502**.

It is to be noted that the provision of the flame holder **4*a* enables the second-stage premixture flow 402 to be stably burned even if the fuel concentration thereof is lower than that of the second-stage combustion flame 502. In addition, even when the first-stage combustion flame 501 is quenched, the second-stage premixture flow 402** can be burned independently and stably. This fact has been confirmed with experiments.

Figure 6:
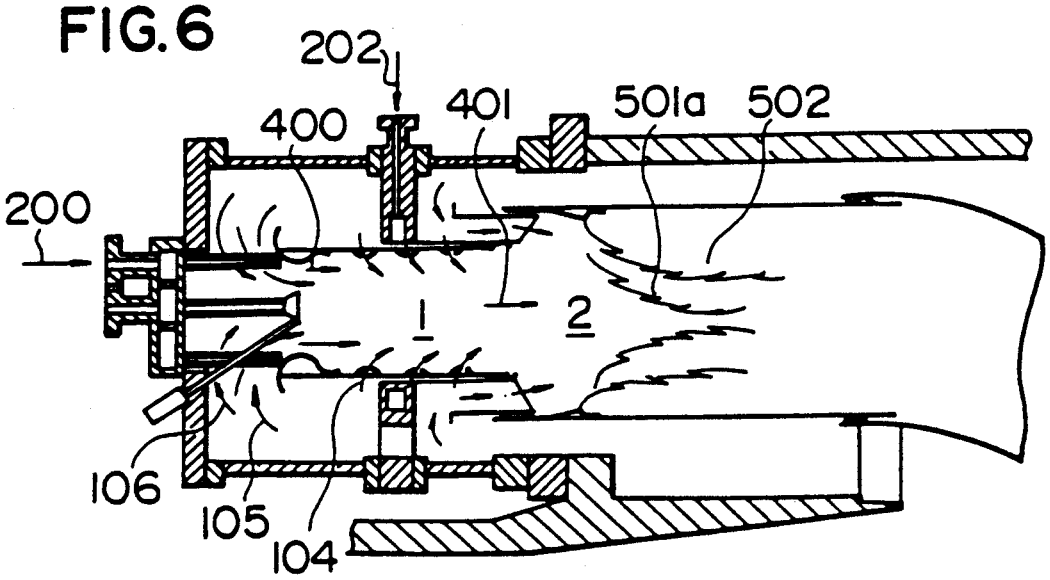

Then, after time (2) at which the change from first stage combustion to the second-stage combustion, a change to safe combustion is effected at time (3) under load conditions which are substantially the same as those used at time (2). Specifically, as shown in FIG. 3, the supply of the auxiliary fuel 201 is stopped, and the flow of fuel that corresponds to the amount of the auxiliary fuel 201 to be supplied is added to the flow of the first-stage fuel 200. This first-stage fuel 200 is supplied to the first-stage combustion chamber 1, thereby accomplishing the change to safe combustion. More specifically, the auxiliary-burner flame 500 (refer to FIG. 5) is extinguished to cancel the effect of holding the first-stage combustion flame 501 within the first-stage combustion chamber 1, thereby flowing out the first-stage combustion flame 501 in the downstream direction. Then, this flame is, as shown in FIG. 6, held by the second-stage combustion flame 501 formed in the second-stage combustion chamber 2 so as to maintain the combustion.

Under these conditions, all the flames are premixed combustion flames. More specifically, as the auxiliary-burner flame within the first-stage combustion chamber 1 is extinguished, the first-stage fuel 200 together with the first-stage combustion air 105 and 104 flows into the first-stage combustion chamber 1, and they are uniformly mixed until they reach the second-stage combustion chamber 2. In this manner, the premix combustion of the first-stage flame 500 and the second-stage flame 502 is achieved.

Then, under conditions when the change to the complete premixed combustion was completed at time (3) of FIG. 3, the flow rate of fuel is increased while the first-stage fuel 200 and the second-stage fuel 202 are being controlled to be respective predetermined fuel ratios, and the gas turbine is caused to run until it reaches rated conditions (4). During this time, it is possible to prevent a first-stage combustion flame 501*a* from flash back into the first-stage combustion chamber 1 by increasing the flow velocity of mixture to a sufficient degree. In order to actively prevent such a flash back, the flame arrestor board 14 is secured in advance to the downstream end of the first-stage combustion liner 3 so that the flow velocity is further increased. Since the flow velocity of the first-stage mixture ca be increased to a sufficient extent in this manner, flame holding can be effected by utilizing the auxiliary-burner flame 500 during combustion in the first-stage combustion chamber 1. Accordingly, it is possible to provide a flame-holding effect which is greater than that achieved by a normal swirling device or the like. Accordingly, the flow velocity can be further increased and, therefore, conditions which do not easily lead to backfires can be selected.

When the load level of the gap turbine is to be decreased or the gas turbine is to be stopped, the operation may be performed in the order reverse to that described above. Specifically, under the rated conditions, the first-stage fuel 200 and the second-stage fuel 202 are gradually throttled at respective predetermined ratios. When the conditions at time (3) are reached, the auxiliary burner is fired by means of the sparking plug 25 while a portion of the first-stage fuel 200 is being supplied to the auxiliary-burner side. In this manner, the first-stage fuel 200 is burned while the flame is being held at the head of the first-stage combustion chamber 1, and the combustion flame 501*a* of the first-stage fuel 200 which has burned in the second-stage combustion chamber 2 disappears, whereby switching is achieved smoothly. The operation executed until the gas turbine stops is completely the same as that of a conventional two-stage combustion system. Specifically, the supply of the second-stage fuel 202 is stopped, and the corresponding amount of fuel is added to the first-stage fuel 200 and the auxiliary-burner fuel 201, thereby reducing all the flames to the first-stage combustion flame alone. When the supply of the fuel is further reduced, the gas turbine stops.

As described above, in accordance with the embodiment of the present invention, the auxiliary burner is provided so that a diffusion flame formed in an upstream portion of the combustor is stabilized by means of the flame-holding effect of the auxiliary burner. In addition, the second-stage premixed combustion chamber having a flame holder is provided in a downstream portion of the combustor so that the aforesaid premix-combustion flame, which is fired and stabilized at the first stage, can stably burn in itself. In the above construction and arrangement, the firing and extinguishing of the auxiliary burner can be utilized to realize one combustion mode in which diffusion combustion and premix combustion are effected on upstream and downstream sides, respectively, and another combustion mode in which the first-stage fuel and the second-stage fuel are both subjected to complete premixed combustion within the second-stage combustion chamber in a downstream portion of the combustor.

Figure 7:
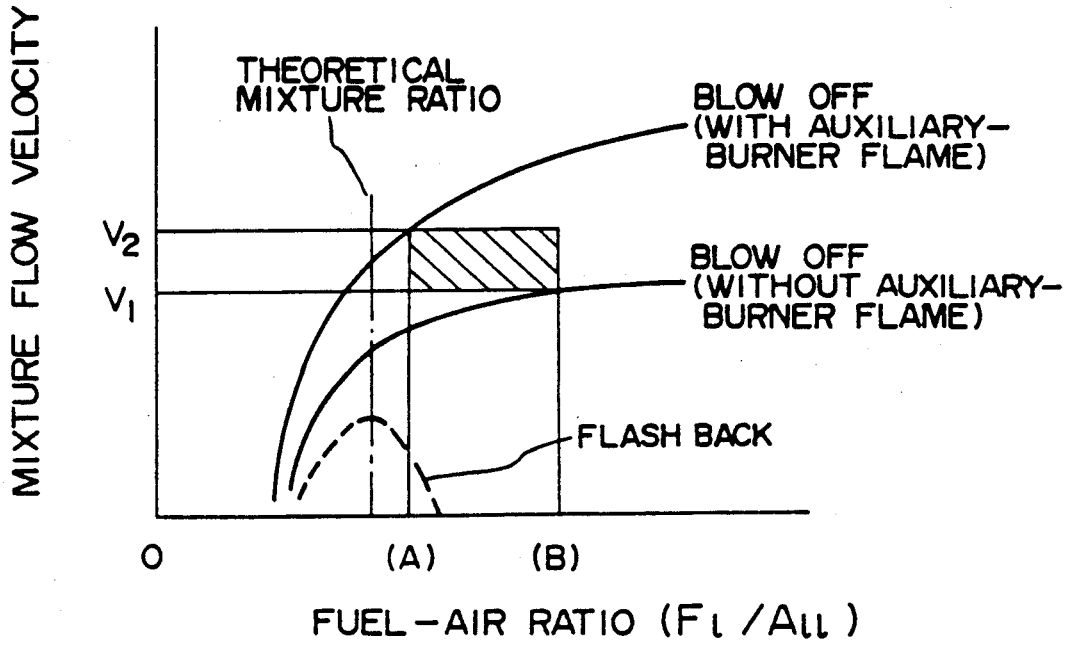
FIG. 7 is a graphic presentation showing the operating conditions of a first-stage combustion.

The following is a description of the switching between the combustion modes according to the present invention and the combustion conditions required to realize low-NOx combustion. First of all, regarding the first-stage combustion, the relationship between a first-stage premixture flow rate (V), a first-stage fuel (shown at 200 in FIG. 2; represented by $F_1$ in FIG. 7), and premixing air (shown at 106 in FIG. 2; represented by $A_{11}$ in FIG. 7) in the first-stage combustion air will be explained with reference to FIG. 7. FIG. 7 illustrates the proper range of theaforesaid relationship. It is known from the relationship between a fuel-air ratio and the flow velocity of mixture that a premix-combustion flame is stabilized in an intermediate range between the region of flash back corresponding to low-speed conditions and the region of blowoff corresponding to high-speed conditions. If the fuel-air ratio (the mixture ratio of fuel to air) is substantially equal to the theoretical mixture ratio, the flow velocity of the mixture at the time of flash back (called "flash back flow velocity") is the fastest. If the fuel-air ratio is set to meet conditions under which the fuel concentration is higher than that determined by the theoretical mixture ratio, the flash back flow velocity falls, while the flow velocity of the mixture at the time of blowoff (called "blowoff flow velocity") rises, whereby the stable range of flame expands. If there is an auxiliary flame, the blowoff flow velocity will be made even greater and stabler. In the present invention, by utilizing the characteristics of the above-described premixed flame, the operating fuel-air ratio of the premixture for the first-stage combustion flame is selected to be not lower than the theoretical mixture ratio and, within the operating range defined between (A) and (B) in FIG. 7, the flow velocity of mixture is set within the range between a blowoff velocity $V_1$ with no auxiliary flame and a blowoff velocity $V_2$ with an auxiliary flame (a shaded portion in FIG. 7). If the fuel-air ratio of the premixture is made greater than (B), the flame loses the characteristics of premix-combustion flame and becomes diffusion flame, so that the phenomenon of flash back disappears. However, since the phenomenon of blowoff continuously exists, air need not necessarily be premixed in the first-stage combustion chamber as described above. The object of premixing air is to restrict the safe range of premix combustion more definitely than that of diffusion flame in accordance with combustion conditions and to realize low NOx combustion. The fuel-air ratio of the auxiliary burner is set to a ratio close to the theoretical mixture ratio at which diffusion flame normally becomes the stablest. The total fuel-air ratio realized in the first-stag combustion chamber 1 (including the auxiliary burner) is set to a fuel-air ratio which is smaller than the theoretical mixture ratio owing to the first-stage combustion air 104 (104*a*, 104*b*) which are supplied through the openings 3*a* (3*b*, 3*c*) formed in the wall portion of the first-stage combustion liner 3. Specifically, an equivalent ratio (fuel-air ratio/theoretical fuel-air ratio) is set to approximately 0.7 or below. Then, in order to achieve low-NOx combustion, the conditions of the second-stage combustion are set so that the fuel concentration becomes low as in the case of the first-stage combustion. Specifically, an equivalent ratio is set to approximately 0.7 or below.

Figure 8:
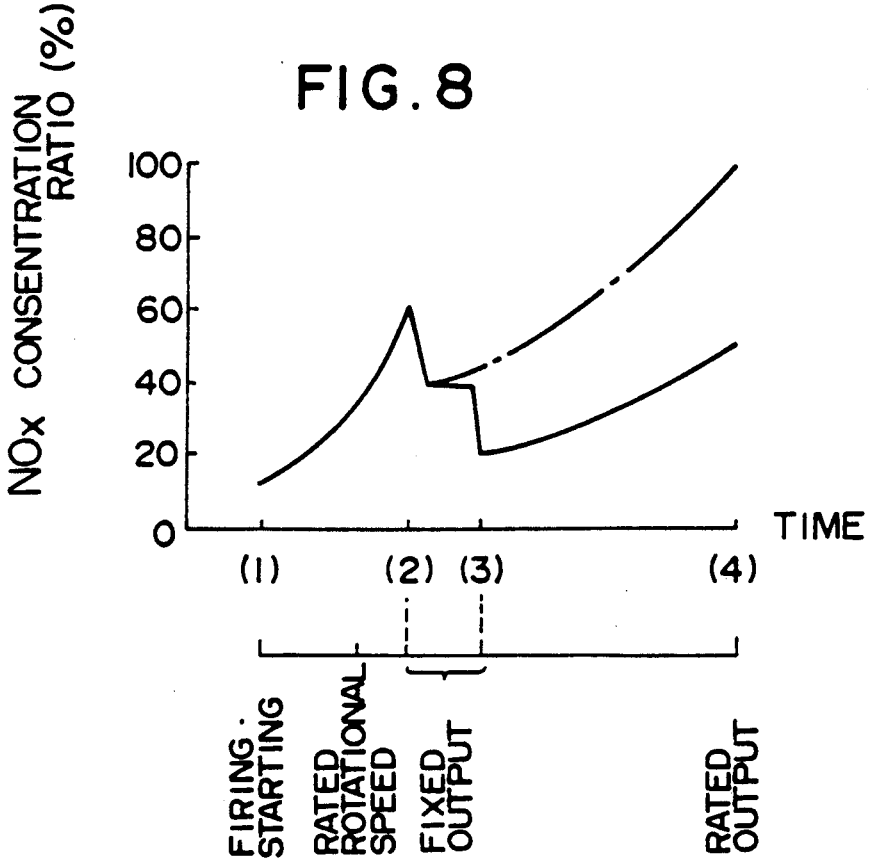
FIG. 8 is a graphic presentation showing NOx characteristics achieved by the present invention.

FIG. 8 shows NOx characteristics according to the present invention. The running method is the same as the one explained in connection with FIG. 7. In FIG. 8, within the region between (1) and (2), the gas-turbine combustor is made to run with the first-stage combustion only and, because of a diffusion-combustion region, the amount of NOx increases at a relatively large ratio with an increase in the input of fuel. Under predetermined low-output conditions at time (2), the combustion changes from first-stage combustion to second-stage combustion and the second-stage combustion changes into premixed combustion, thereby reducing the NOx concentration. At time (3), the combustion proceeds to complete combustion, and the NOx concentration becomes further low owing to the premixed combustion in the first-stage combustion. Under rated-out conditions at time (4), the NOx concentration becomes approximately 50% lower than the one, indicated by a dot-dashed line, of a conventional type of diffusion-premix two-stage combustion system.

Figure 9:
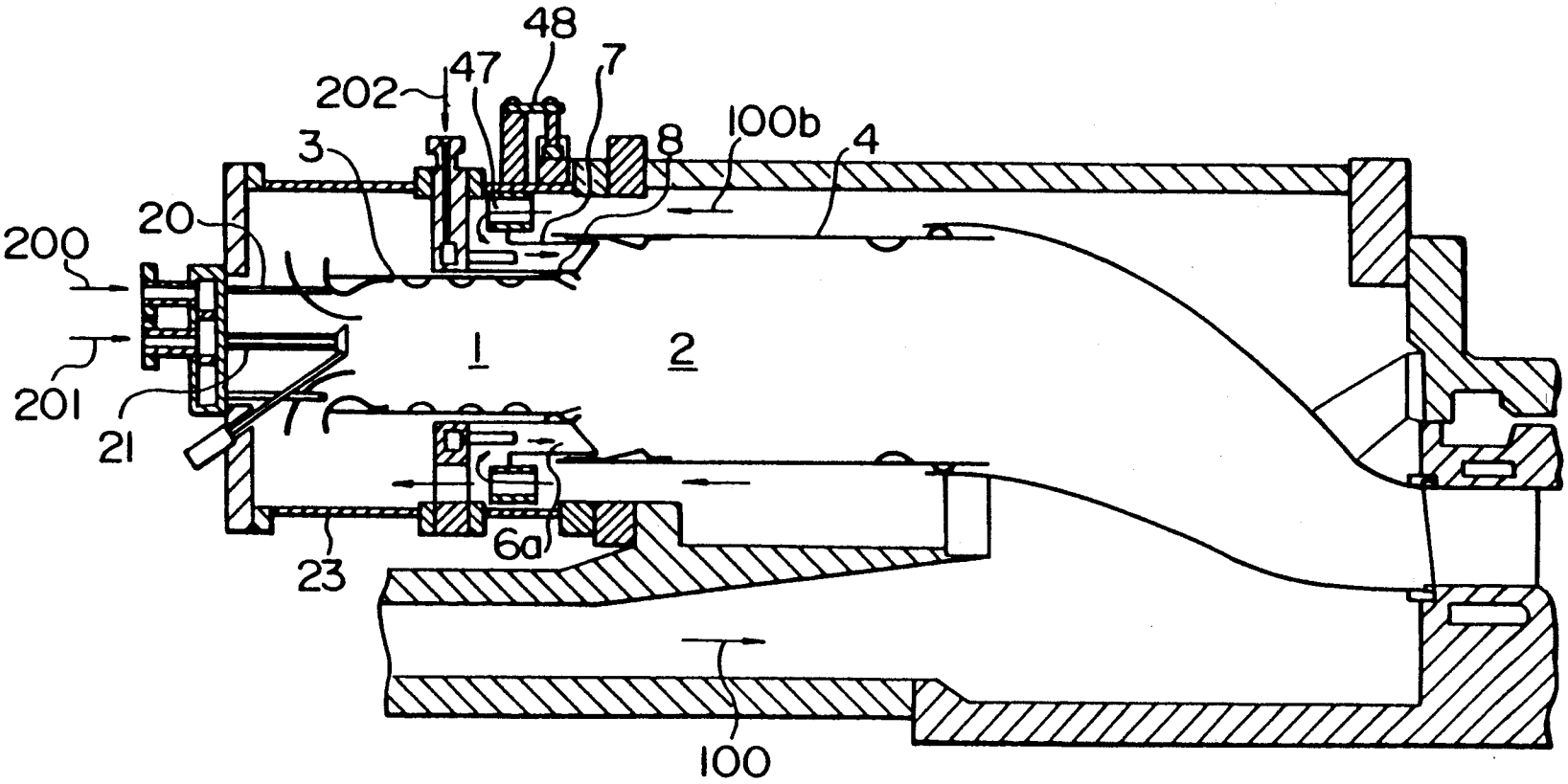
FIG. 9 is a longitudinal sectional view showing another embodiment of a gas turbine combustor in accordance with the present invention.

FIG. 9 is a view showing a modification of the embodiment of the present invention. In the illustrated modification, a movable ring 47 and a movable-ring controlling device 48 are provided at an inlet portion at which the second-stage combustion air 102 flows into the premixing chamber 6a, and the movable-ring controlling device 48 is capable of driving the movable ring 47 by operation from the outside of an external cylinder 23 of the combustor. If the above-described structure is utilized to provide flow control over the second-stage combustion air, under light-load running conditions in which the flow rate of fuel is small, the movable ring 47 is caused to travel in the direction in which an air inlet port is closed to thereby reduce the flow rate of air so that the fuel-air ratio of the second-stage premixture flame is controlled within an appropriate range. Accordingly, even under lighter-load running conditions, it is possible to achieve complete premixed combustion (the state indicated at (3) in FIG. 3) which realizes low-NOx combustion.

Figure 10:
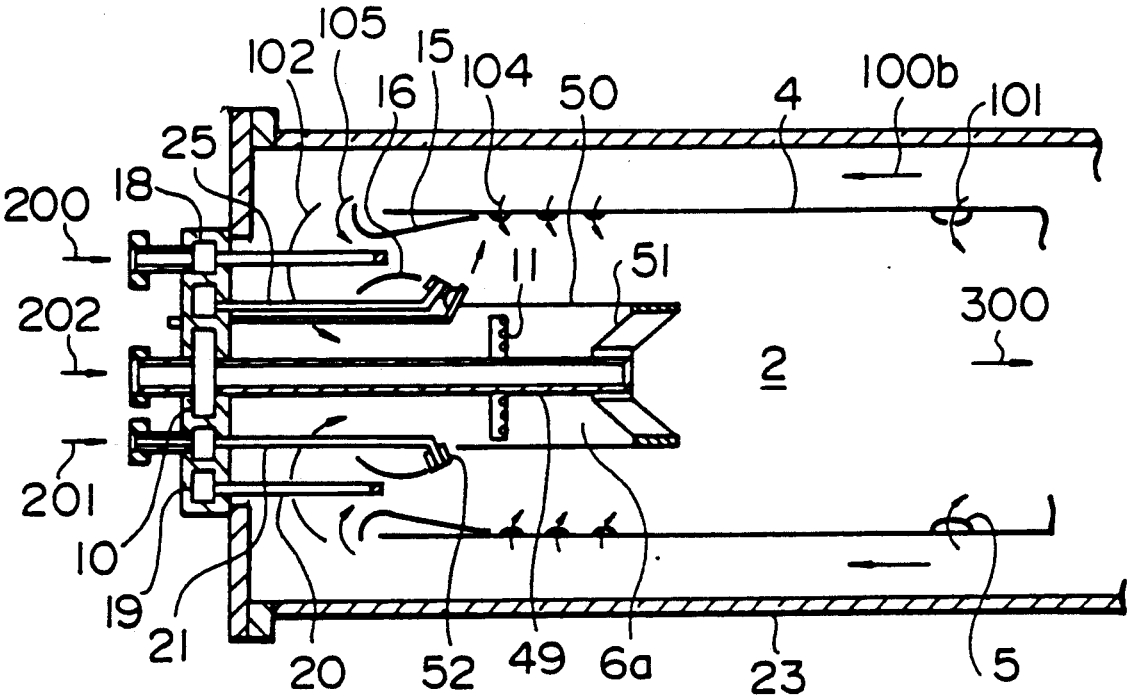
FIG. 10 is a longitudinal sectional view showing still another embodiment of a gas turbine combustor in accordance with the present invention.
Figure 11:
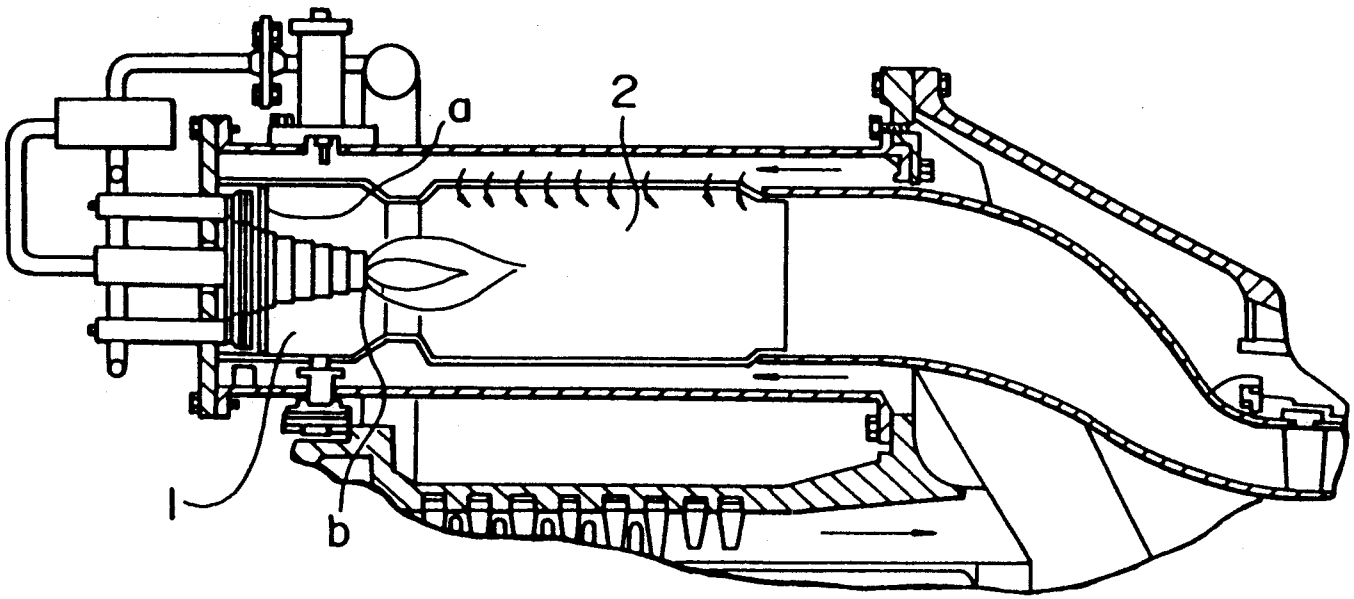
FIG. 11 PRIOR ART
FIG. 11 is a longitudinal sectional view showing a conventional gas turbine combustor.

FIG. 10 shows another modification of the embodiment of the present invention. In this modification, the second-stage combustion chamber 2 is disposed substantially in the center of the entire combustor, and the first-stage combustion chamber 1 is disposed around the inner periphery of an upstream end portion of the second-stage combustion chamber 2. More specifically, the liner cap 15 is disposed around the periphery of the upstream end portion of the combustion liner 4, and the auxiliary-burner cap 16 is provided within the circumference of the liner cap 15 in a coaxial relationship. The auxiliary-burner cap 16 extends in the downward direction and a second-stage premixer sleeve 50 extends into the second-stage combustion chamber 2 in the downstream direction thereof. A second-stage fuel supply pipe 49 extends through the second-stage premixer sleeve 50, and a plurality of second-stage fuel nozzles 11 are attached to an intermediate portion of the second-stage fuel supply pipe 49, while a swirling device 51 is attached to a downstream end portion of the same. A plurality of first-stage fuel nozzles 20 extend into an annular air passage formed by the aforesaid liner cap 15 and the auxiliary-burner cap 16, and a plurality of auxiliary burners 52 are secured to the junction between the auxiliary-burner cap 16 and the second-stage premixer sleeve 50.

In the above-described structure, when the auxiliary burner 52 is fired, first-stage combustion flame is formed in the first-stage combustion chamber 1 and second-stage premixture flame is held in the swirling device 51, thereby forming flame in the second-stage combustion chamber 2. In such a state, when the auxiliary-burner flame is extinguished, the flame-holding effect within the first-stage combustion chamber 1 is lost and the first-stage combustion flame flows in the downstream direction. This flame is held in the second-stage combustion chamber 2 owing to the second-stage combustion flame and thus undergoes premixed combustion. With this structure, it is possible to achieve effects and advantages similar to those obtained in the above-described modification and it is also possible to provide a combustor of compact design.

In a two-stage combustion type of gas turbine combustor according to the present invention, the switching of fuel supply from the first-stage combustion chamber to the second-stage combustion chamber, that is to say, the operation of switching fuel supply does not cause an overload to the second-stage combustion chamber or unstable combustion therein, since the first-stage and second-stage combustion can be changed into premixed combustion with neither excessive load nor insufficient load applied to each of the combustion stages. In particular, heat load to combustor hardware is reduced. Moreover, after change to premixed combustion has been completed, complete premixed combustion without any diffusion combustion is realized and the NOx concentration is approximately half that of a conventional low-NOx combustor of the type in which diffusion combustion is combined with premixed combustion.

What is claimed is:

1. A method of driving a gas turbine combustor including a first-stage combustion chamber provided in an upstream portion of said combustor and having a device for supplying air and fuel, a second-stage combustion chamber provided on the downstream side of said first-stage combustion chamber and having a device for supplying air and fuel, and a combustor transition piece provided on the downstream side of said second-stage combustion chamber and arranged to conduct a high-temperature combustion gas produced in said combustion chamber into a turbine apparatus, said gas turbine combustor being arranged such that, at the time of starting of said combustor, a flame in said first-stage combustion chamber is extinguished after combustion has been brought about in said first-stage and second-stage combustion chambers and, thereafter, said first-stage combustion chamber is caused to serve as a premixing chamber for said second-stage combustion chamber, said method comprising the steps of preparing an auxiliary burner in said first-stage combustion chamber, said auxiliary burner being sparked when said combustor is fired, and causing said first-stage combustion chamber to serve as said premixing chamber for said second-stag combustion chamber by extenguishing said auxiliary burner.

2. A method of driving a gas turbine combustor including a first-stage combustion chamber provided in an upstream portion of said combustor and having a device for supplying air and fuel, a second-stage combustion chamber provided on the downstream side of said first-stage combustion chamber and having a device for supplying air and fuel, and a combustor transition piece provided on the downstream side of said second-stage combustion chamber and arranged to conduct a high-temperature combustion gas produced in said combustion chamber into a turbine apparatus, said gas turbine combustor being arranged such that, at the time of starting of said combustor, a flame in said first-stage combustion chamber is extinguished after combustion has been brought about in said first-stage and second-stage combustion chambers and, thereafter, said first-stage combustion chamber is caused to serve as a premixing chamber for said second-stage combustion chamber, said method comprising the steps of preparing an auxiliary burner in said first-stage combustion chamber, said auxiliary burner being sparked when said combustor is fired, causing said auxiliary burner to hold a combustion flame in said first-stage combustion chamber, extinguishing said auxiliary burner, feeding said combustion flame from said first-stage combustion chamber to said second-stage combustion chamber, and causing said first-stage combustion chamber to serve as a premixing chamber for said second-stage combustion chamber.

3. A method of driving a gas turbine combustor according to claim 8 or 9, wherein the ratio of fuel to air which is supplied to said first-stage combustion chamber fuel is selected so that the proportion of fuel is smaller than that of fuel determined by a theoretical mixture ratio.

4. A method of driving a gas turbine combustor according to claim 3, further comprising the steps of supplying lean fuel from a section for supplying fuel and air with the concentration of fuel made higher than that of fuel determined by the theoretical mixture ratio, and supplying additional combustion air midway in said combustion chamber to adjust the ratio of fuel to air in said first-stage combustion chamber so as to make the concentration of fuel lower than that of fuel determined by said theoretical mixture ratio.

5. A method of driving a gas turbine combustor according to claim 4, wherein the ratio of fuel to air which is supplied to said first-stage combustion chamber in 0.7 to 0.5 in terms of an equivalent ratio.

6. A method of driving a gas turbine combustor according to claim 5, wherein the ratio of fuel to air which is supplied to said second-stage combustion chamber is 0.4 to 0.7 in terms of an equivalent ratio, while the ratio of fuel to air which is supplied to said auxiliary burner is 0.8 to 1.25 in terms of an equivalent ratio.

* * * * *